US006113077A

United States Patent [19]

Fargher et al.

[11] Patent Number: 6,113,077

[45] Date of Patent: Sep. 5, 2000

[54] RACING RAIL AND POST COVER APPARATUS

[75] Inventors: Rex John Fargher; Barrie Gilbert Woodhouse, both of Mt Barker, Australia

[73] Assignee: Aclis Pty Ltd, Australia

[21] Appl. No.: 09/096,239

[22] Filed: Jun. 11, 1998

[51] Int. Cl.[7] ..... A63K 1/00

[52] U.S. Cl. ..... 256/65; 472/86; 472/85; 256/24; 52/460

[58] Field of Search ..... 403/65; 256/24, 256/13.1, 59, 65; 404/6, 7, 8; 52/460, 469, 169.7; 472/86, 85

[56] References Cited

U.S. PATENT DOCUMENTS

| | | | |
|---|---|---|---|
| 2,168,930 | 3/1939 | Bradshaw | 256/13.1 |
| 2,187,556 | 7/1939 | Gill | 256/13.1 |
| 3,149,436 | 9/1964 | Varlonga | 52/460 |
| 3,213,583 | 10/1965 | Winski | 52/469 |
| 3,376,679 | 4/1968 | Gregoire | 52/469 |
| 3,518,704 | 7/1970 | Shanni | 52/169.7 |
| 4,009,548 | 3/1977 | Hicks | 52/469 |
| 4,443,002 | 4/1984 | Fontana | 256/59 |
| 4,553,875 | 11/1985 | Casey | 404/6 |
| 5,713,158 | 2/1998 | Gibbs | 52/460 |

*Primary Examiner*—Lynne H. Browne
*Assistant Examiner*—Kenneth Thompson
*Attorney, Agent, or Firm*—Klauber & Jackson

[57] ABSTRACT

Offset racing rail arrangements (16) of the fixed and relocatable variety are made safer by fitment of a cover designed to prevent riders from falling between and sometimes onto the poles which support the racing rail. A cover (22) is provided which is releasably attachable to a receptacle portion of the rail which is also resiliently spaced by a support means from the posts (10) which support the rail. The cover (22) is one embodiment comprises sheet material (24) bent (30, 32, 34, 36 and 38) underneath itself in such a manner as to provide a resilient self supporting spacing from each posts (10). The cover (22) is also in the embodiment provided with an edge portion (26) adapted to releasbly attach to a receptacle portion (56) of the rail without the use of fasteners.

15 Claims, 4 Drawing Sheets

24
72
62
60
66
68
74
64
70

10

24
56
25
58
26
48
20
50
46
44
54
52

RACING RAIL AND POST COVER APPARATUS

This invention is described in the following statement:—This invention relates to racing rails and in particular to a cover that overlies the post and the space between successive posts which support the racing rail.

BACKGROUND

Racing rails are used to create a boundary to a racing track. The rail which forms the inner and outer boundary of a horse racing track is offset inwards of the posts which support the rail. The rail is also offset at a level above the ground which is approximately equal to the level of the body portion of horses which race on the track.

If and when a jockey is dismounted during a race or training, the area underneath the offset portion of the rail and posts provides a relatively safe haven from the horses following in the path of the fallen jockey.

However, the offset rail arrangement creates a problem of its own. If the jockey is dismounted in a sideways direction while also having a high forward velocity, that jockey is likely to suffer serious injury when they fall from above and into the offset area and collide heavily with the upright posts which support the rail.

To prevent such an occurrence, covers have been placed on top of the area between posts as well as over the posts. An example of such an arrangement is disclosed in U.S. Pat. No. 4,443,002, to Fontana dated Apr. 17, 1984.

The Fontana specification discloses an invention related to the placement of generally L-shaped elongated panels in overlapping relationship from end to end on the upper and inside region of the race track rail and post arrangement. The panels are designed to soften the landing of a displaced jockey and further the Fontana invention relates to the shape of its upper surface which is designed to direct the fallen rider away from the race track.

However, this arrangement has a number of problems.

Firstly, the Fontana rail and post guard is typically made of plastic and it is known for the plastic to become brittle after prolonged exposure to the environment. When the cover is brittle it is likely not to withstand the impacts it was initially designed to deal with and the cover may consequently break and cause unnecessary injury.

Secondly, the Fontana racing rail and post guard is very labour intensive to install. So much labour is involved that, it is generally used only on fixed-in-the-ground posts and rails and is not used on relocatable post and rail arrangements.

Thirdly, the fixing methods used to secure the Fontana racing rail and post guard to the posts and rails are expensive and time consuming since many pop rivets or tek screws are used to connect the cover not only to the rail but also the support brackets connected to the offset shaped posts.

Thus it is proposed that there is a need for an attachment method and means which provides a cover which is long lasting, reliably resilient and simple enough to fit such that it can be used on both fixed and relocatable racing post and rail assemblies.

BRIEF DESCRIPTION OF THE INVENTION

In its broadest form the invention is a racing rail guard assembly for a racing post and offset rail assembly having a rail supported by at least two posts comprising:

a sheet having an edge portion on a longitudinal side thereof which is shaped to attach to a receptacle portion on the inner side of the rail; and a support member located below the sheet adapted to resiliently space the sheet from the post.

Preferably the attachment between said sheet and rail is releasable and does not include fasteners.

Preferably the sheet spans at least two of said posts.

Preferably the racing rail guard assembly further comprises a fixing means for fixing the cover to at least one of the posts.

Preferably the receptacle portion of the rail is orientated parallel to the longitudinal axis of the rail and said edge portion comprises an upwardly folded flange portion of the sheet arranged to releasably attach to the receptacle portion.

Preferably the support member for the racing rail guard assembly comprises a return flange or leg integrally formed with the sheet and which extends along the underside of the sheet and is curved or bent into a shape which resiliently spaces the sheet from the post.

Preferably the return flange or leg is corrugated.

A specific embodiment of the invention will now be described in some further detail with reference to and as illustrated in the accompanying figures. This embodiment is meant to be illustrative, and not restrictive of the invention.

DETAILED DESCRIPTION OF THE DRAWINGS

DETAILED DESCRIPTION OF AN EMBODIMENT OF THE INVENTION

Figure 1:
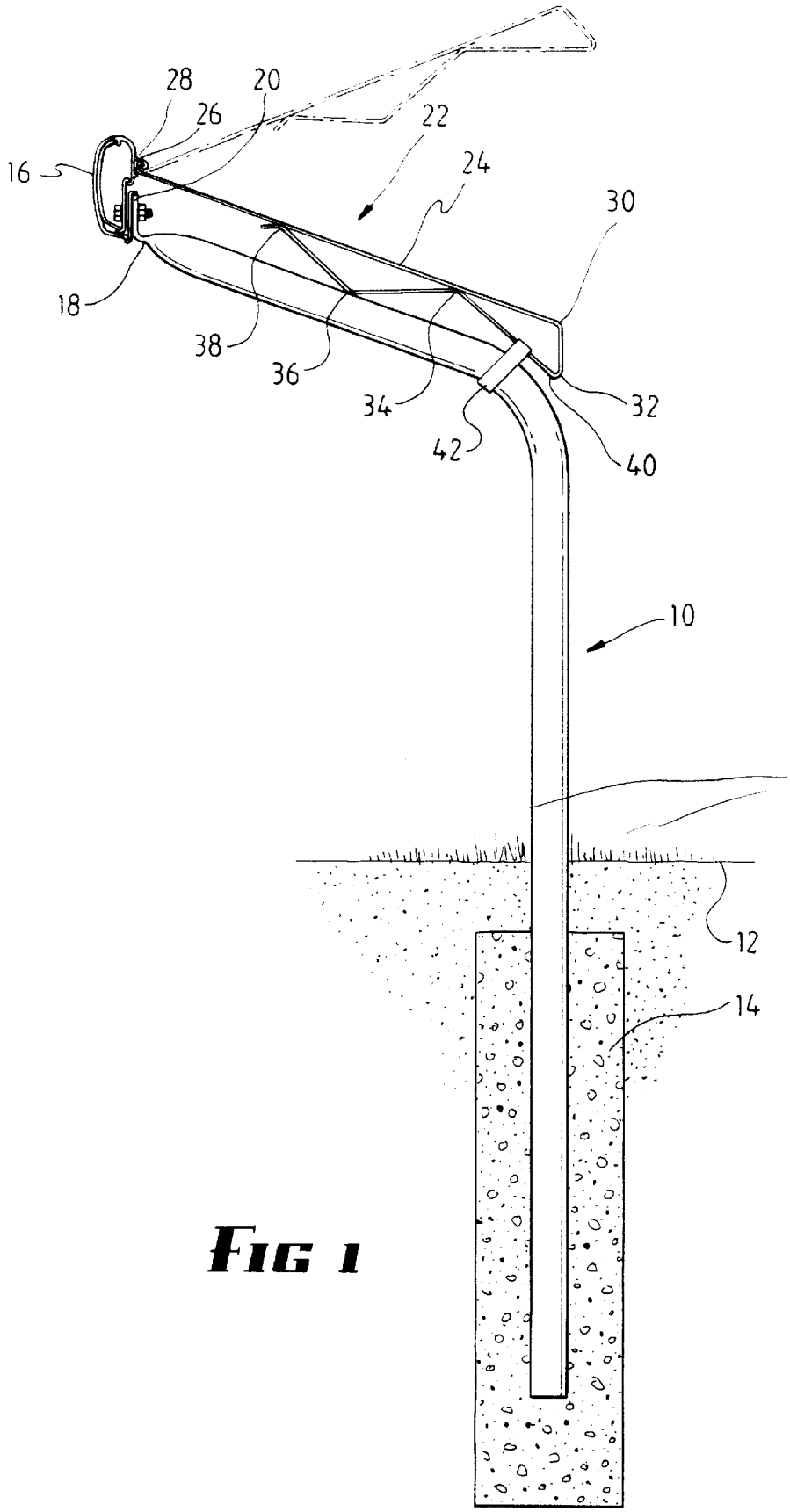
FIG. 1 depicts a side view of a post and rail assembly having a cover sheet according to the invention thereon.

A post 10 is shown embedded in the ground 12 in a typical manner for a fixed post and rail assembly in FIG. 1. The embodiment discloses the use of a fixed in-ground post and rail assembly but is equally applicable to relocatable versions. In the fixed version, concrete 14 is used to secure the lower end of the post 10 in the ground and also provide a resistance to the substantial sideways forces which could impinge on the rail and/or post in the event of an accident involving horses and their jockeys. The following distance measurements described in association with the figure are typical only and do not limit in any way the invention, its embodiment or its implementation.

The assembled rail 16 is located approximately 600 mm inwards of the post 10, ie offset inwards towards the location where horses would be racing as well as being approximately 1000 mm off the ground.

The post is bent over from about 600 mm off the ground surface and slopes at about 30 degrees to its free end 18.

Typically, the post is constructed of galvanised pipe being relatively easy to machine bend to conform to the shape depicted, including the lug 20 which is formed by clamping the pipe end flat and bent so as to be vertical at its free end. A slot is used in the vertical flat portion to allow the variations of post height to be accommodated while installing the rail a constant height above the actual ground surface.

A nut and bolt is one of many fixing means that can be used to attach the lug 20 at the free end of post to the rail.

Figures 2, 4:
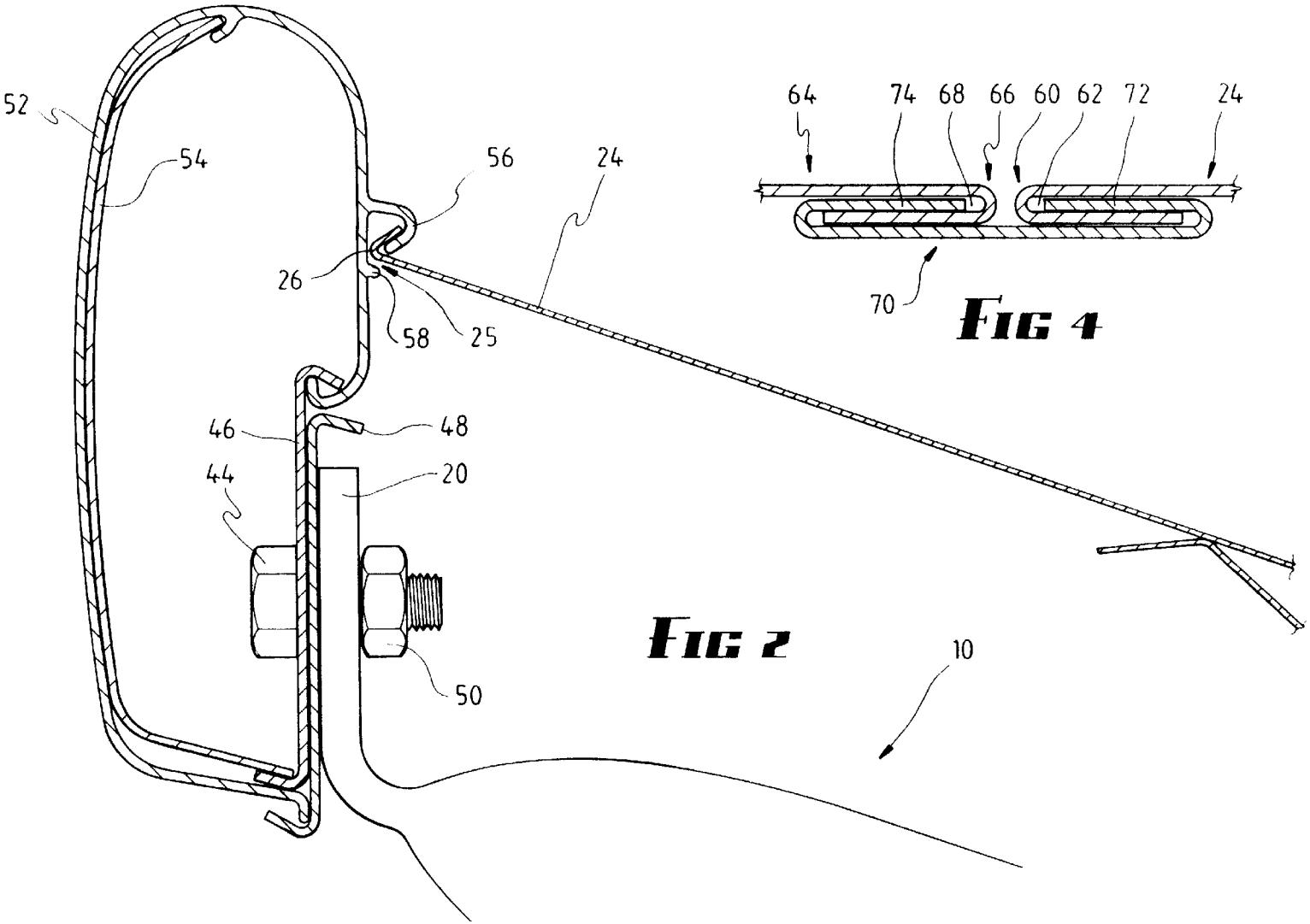
FIG. 2 depicts a partial section view of the rail and cover sheet attachment of the described embodiment.
FIG. 4 depicts a joiner element and the end profiles of adjacent cover sheets.

An embodiment of a racing rail guard assembly according to the invention is depicted at 22. The racing rail guard assembly comprises in this embodiment a substantially planar sheet upper portion 24 which is releasably attached at one of its longitudinal sides 26 with the inner upper periphery 28 of the assembled rail 16. The detail of an embodiment of this engagement is depicted in FIG. 2 and will be described later in the specification.

The opposite longitudinal side 30 of the substantially planar upper portion 24 is bent underneath itself to form, in this embodiment, a corrugated resilience enhancing structure below the cover sheet. The term sheet will also be used to refer to the cover sheet arrangement.

The first bend of the sheet at 30 orientates the sheet substantially vertically downwards and is bent so as to provide a smooth, non-cutting outer edge to the sheet structure above the posts. This relatively smooth surface will prevent horses, jockeys and others from cutting themselves if they happen to move along this side of the post and rail assembly. The bend at 30 may have a continuous curvature from the upper surface portion 24 to its underside forming a semi-circular outer shape so as to further minimise potential damage to a person or animal striking this area of the structure which also provides structural strength to the span of the sheet between posts.

The second bend at 32 returns the sheet material towards the underside of the sheet upper portion 24 and after abutting the sheet along the longitudinal length of the third bend 34 the sheet material returns to the post overhang (offset portion). The fourth bend 36 only rests on the post and rail assembly at each post offset portion along the length of that section of racing rail guard assembly. Finally, and only preferably, the fifth bend 38 rests again on the underside of the sheet upper portion 24. This configuration is only preferable. The sheet has been found easy to manufacture, transport and handle. However, there are other ways for providing support to the cover and in particular to resiliently supporting the cover, for example the provision of a resiliently compressible foam block located between the underside of the upper portion of the sheet and a post or the upper sheet portion and a lower sheet portion.

In the embodiment depicted in FIG. 1, along the longitudinal length of the sheet the resilient support structure below the sheet forms a support for the upper sheet portion, in particular at the bends 34 and 38.

The bend 36 and the point of fixing 40 of the structure provides support on the top of the offset portion of the post. The material of the sheet is preferably sheet metal and is also preferably suitably galvanised or coated to prevent degradation by the effects of the environment. The exposed areas of the sheet may carry indica of the nature of advertising if preferred. The sheet could also be made of a suitable Ultra Violet radiation stabilised plastic.

In the embodiment described, the galvanised and colour coated sheet metal used is of relatively thin gauge. An unbent sheet of similar gauge unsupported between posts may not adequately perform the task required, whereas the bent and corrugated form of the cover is self supporting, and strong enough to withstand the forces involved. It is resilient in its construction so as to give sufficient spring to lessen the deceleration of the impact of jockey and/or horse and to minimise injury to both.

The fixing 42 used in this embodiment, comprise a simple U-clamp, and nuts and bolts arranged so that the fixing can be performed simply and firmly without special tools. The positioning of the clamp is such that the sheet 22 is preferably drawn away from the rail thereby tightening the attachment between the sheet and the rail along the length of the receptacle portion of the rail although the attachment is arranged to keep the sheet 22 in position even without the use of fixing or the tightening of a fixing.

FIG. 2 depicts the free end of the post 10 and its lug 20 having a slot (not shown) through which a bolt 44 is placed for clamping brackets 46 and 48 of the rail to the free end of the post. The nut 50 is tightened from the outside of the rail thereby securing the outer cover 52 and inner cover 54 of the rail to the post where the cover 54 is primarily used to support the joint between adjacent outer cover elements 52.

The outer cover 52 faces towards the track used by the horses and also extends around to the top of the post 10 rearward of the assembled rail 16 which may also but not necessarily have a strengthening member inserted along its length in its inner topmost region, possibly a galvanised or aluminium pipe of appropriate dimensions typically at the joint between adjacent rail covers 52.

In one embodiment of a means to effect attachment of the sheet to the rail a lug 56 incorporating a receptacle for the sheet is located on the outer sheet 52 of the rail and projects rearwardly and preferably along the full longitudinal length of the rail but not necessarily so. The lug 56, also referred to as a receptacle member, is shaped so as to provide a lower open access for the sheet 22 to the attachment means of the rail. A ridge 58 is located on the rail and is useful for guiding the sheet 22 as it is inserted in the lug or serving as a resting position for the sheet as it is attached to the post and rail assembly. The ridge 58 may just as easily be a groove recessed into the wall of the top rail so as to serve a similar purpose to that of the ridge.

The lug 56 is internally shaped in this embodiment to facilitate the easy access and retention of the longitudinal side 26 of the sheet upper portion 24. The longitudinal side of the sheet has an upwardly folded flange portion forming a V-shaped profile to complement a portion of the inner shape of the lug 56.

Attachment of the cover 22 to the assembled rail 16 is achieved by insertion of the upwardly folded flange portion into receptacle member 25 at a first orientation (shown in dotted outline in FIG. 1), followed by rotation downwards to a second orientation, being an installed orientation as shown in FIG. 1.

Many alternative complementary internal shapes of the lug and edge profiles are possible, the embodiment having the advantage (not uniquely so) of providing an attachment arrangement which is easy to engage, provides overlap of the rail to the sheet so that rain and moisture runs easily from the rail surface to the sheet surface and which provides for easy disengagement of rail and cover without the need for a fastener. Even after some period of time during which dirt, insects and other matter may clog the space inside the lug, disengagement of the sheet from the rail can be easily facilitated.

Figure 3:
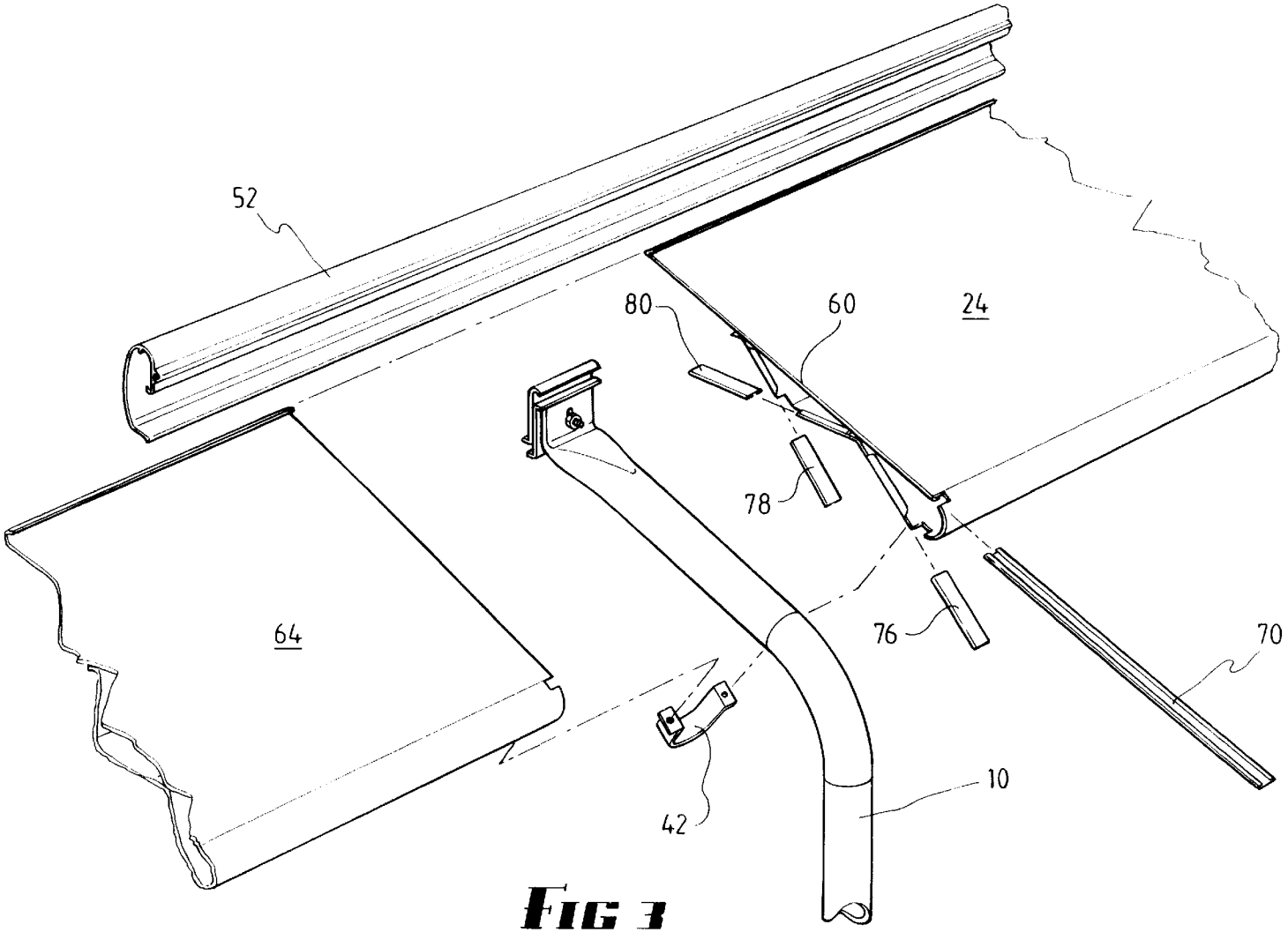
FIG. 3 depicts a perspective view of the fitting together of the cover sheets at their lateral edges.
Figure 5:
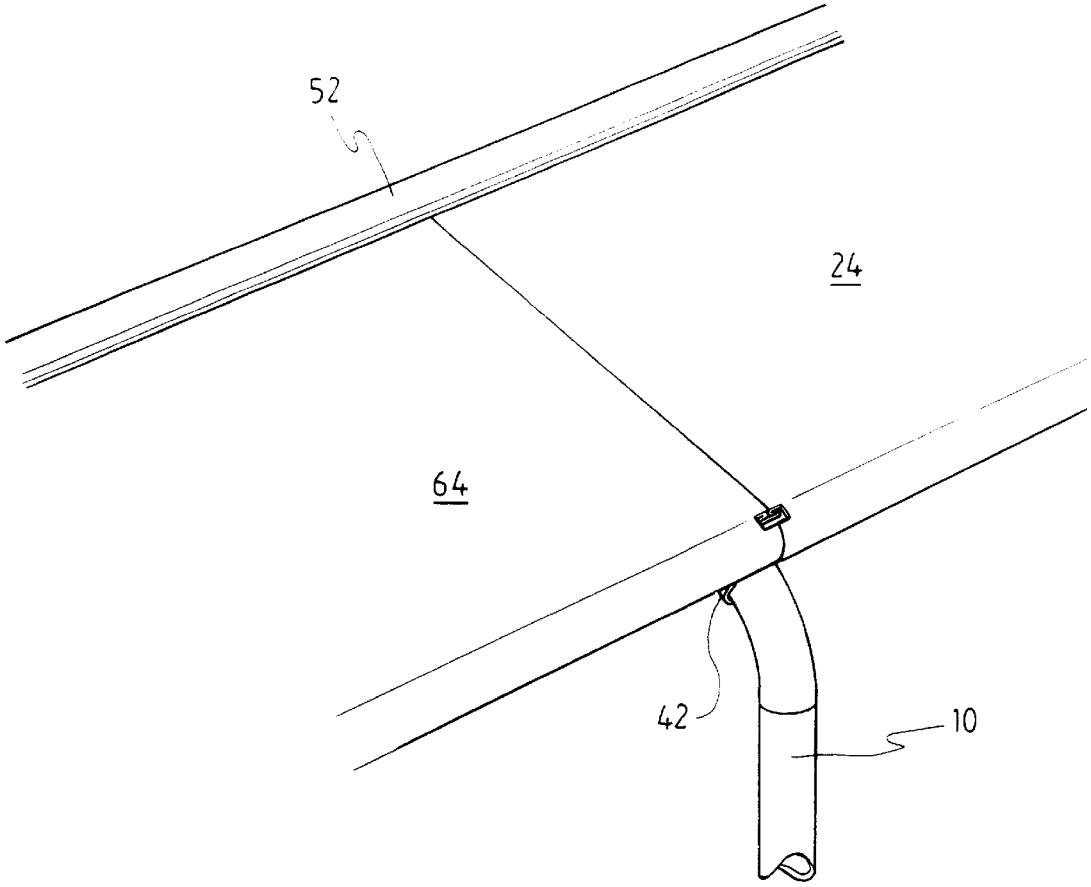
FIG. 5 depicts a perspective view of adjacent cover sheets joined together.

FIG. 3 depicts an embodiment of the way in which the lateral edges of the cover sheets are joined so as to provide a strong, resilient and reliable racing rail guard assembly.

As depicted in detail in FIG. 4, sheet 24 terminates along lateral edge 60 as depicted in FIGS. 3 and 4 with a rolled edge forming a groove 62. Sheet 64 is similarly lateral edge terminated at edge 66 forming a groove 68.

In FIG. 3 the sheets 24 and 64 are shown terminating above a post but this may not always be the case. A joiner element 70 depicted in both FIGS. 3 and 4 comprises a folded sheet metal strip which has a generally "C"-shaped cross-section comprising two tongues 72 and 74 which are adapted to fit into the two grooves 62 and 68 of sheets 24 and 64 respectively.

This arrangement which is merely preferable provides a smooth external surface, at the join of the sheets which presents a small likelihood of the sheets separating to present a sharp edge to a falling jockey or horse. This arrangement is easily fitted and disassembled when necessary.

Similar, but shorter joiner elements 76, 78 and 80 are shown for joining the lower resilient portion of the cover sheets 24 and 64.

For ease of fitting, the lateral edges 60 and 66 of the sheets are provided small indents which allow access for the joiner elements to the aligned and adjacent sheet ends.

It will be appreciated by those skilled in the art, that the invention is not restricted in its use for the particular application described and neither is the present invention restricted in its preferred embodiment with regards to the particular elements and/or features described herein. It will be appreciated that various modifications can be made without departing from the principles of the invention, therefore, the invention should be understood to include all such modifications within its scope.

The claims defining the invention are as follows:

1. A racing rail guard assembly wherein a rail is supported by at least two posts in offset relationship thereto the guard assembly comprising:

a sheet having a proximal longitudinal edge portion which is shaped to be releasably retained in a receptacle portion extending along an inner side of said rail; and a support member located below said sheet adapted to resiliently space said sheet from said posts.

2. A racing rail guard assembly according to claim 1 wherein said attachment between said sheet and rail is releasable and does not include fasteners.

3. A racing rail guard assembly according to claim 1 or claim 2 wherein said sheet spans at least two of said posts.

4. A racing rail guard assembly according to claim 1, further comprising a fixing means for fixing said sheet to at least one of said posts.

5. A racing rail guard assembly according to claim 4 wherein said means for fixing said sheet to at least one of said posts comprises a U-clamp which is located around said post and attached to the underside of said sheet.

6. A racing rail guard assembly according to claim 1 wherein said receptacle portion is orientated parallel to a longitudinal axis of said rail and said longitudinal edge portion comprises an upwardly folded flange arranged to be releasably retained in and rotatably engage with said receptacle portion.

7. A racing rail guard assembly according to claim 5 wherein said flange and said receptacle portion are adapted so that said upwardly folded flange is releasably retained in said receptacle portion by engagement at a first orientation followed by rotation about an axis parallel to said rail to a second orientation, being an installed orientation, wherein said flange is restrained in said receptacle portion.

8. A racing rail guard assembly according to claim 1 wherein said support member comprises said sheet bent or curved back underneath itself and arranged to resiliently space said sheet from a said post.

9. A racing rail guard assembly according to claim 7 wherein said support member is corrugated.

10. A racing rail guard assembly according to claim 7 wherein said sheet has opposite lateral edges each adapted for being arranged to align with an adjacent sheet by the placement of a joining piece along a portion of said lateral edges.

11. A racing rail guard assembly according to claim 9 wherein adjacent sheets have lateral edges folded to form a return flange which are adapted to engage a joining piece, whereby said flange forms a groove adapted to receive an engaging portion of said joining piece formed by the peripheral edges of said shaped joining piece.

12. A racing rail guard assembly according to claim 10 wherein said flanges are located on the underside of the upper lateral edges of said sheet so as to provide when adjacent sheets are joined, a substantially smooth top surface to said guard assembly.

13. A racing rail assembly comprising:

at least two racing posts;

an offset rail having a receptacle portion extending along an innerside thereof; and a cover comprising, a sheet having a proximal longitudinal edge portion which is shaped to be releasably retained to said receptacle portion of said rail; and a support member located below said sheet adapted to resiliently space said sheet from said posts.

14. A racing rail assembly according to claim 12 wherein said attachment between said sheet and rail is releasable and does not include fasteners.

15. A racing rail assembly according to claim 12 or claim 13, wherein said sheet spans at least two of said posts.

* * * * *